US007030560B2

(12) United States Patent
Ko et al.

(10) Patent No.: US 7,030,560 B2
(45) Date of Patent: Apr. 18, 2006

(54) PLASMA DISPLAY PANEL HAVING DUMMY BARRIER RIBS

(75) Inventors: Ji-Sung Ko, Busan (KR); Eun-Gi Heo, Cheonan (KR); Woo-Tae Kim, Yongin (KR)

(73) Assignee: Samsung SDI Co., Ltd., Suwon-city (KR)

( * ) Notice: Subject to any disclaimer, the term of this patent is extended or adjusted under 35 U.S.C. 154(b) by 148 days.

(21) Appl. No.: 10/667,072

(22) Filed: Sep. 18, 2003

(65) Prior Publication Data

US 2004/0056597 A1 Mar. 25, 2004

(30) Foreign Application Priority Data

Sep. 23, 2002 (KR) ..... 10-2002-0057578

(51) Int. Cl.
*H01J 17/49* (2006.01)

(52) U.S. Cl. ..... 313/582; 313/586; 313/634; 313/493; 313/609

(58) Field of Classification Search ..... 313/582, 313/584, 586, 587, 609, 610, 634, 635, 493
See application file for complete search history.

(56) References Cited

U.S. PATENT DOCUMENTS 5,670,843 A * 9/1997 Matsuura ..... 313/582
6,414,434 B1 * 7/2002 Nakano et al. ..... 313/582
6,495,958 B1 * 12/2002 Moon ..... 313/584
6,761,605 B1 * 7/2004 Kado et al. ..... 445/6
6,809,476 B1 * 10/2004 Lee et al. ..... 313/581

FOREIGN PATENT DOCUMENTS

JP 2001-236890 8/2001
KR 2001-0075761 8/2001

OTHER PUBLICATIONS

Korean Patent Abstracts for Publication No.: 1020010075761, Date of publication of application Aug. 11, 2001, in the name of Seok Cheon Ha.
Patent Abstracts of Japan for Publication No.: 2001-236890, Date of publication of application Aug. 31, 2001, in the name of Kazutoshi Morikawa et al.

* cited by examiner

*Primary Examiner*—Joseph Williams
*Assistant Examiner*—Kevin Quarterman
(74) *Attorney, Agent, or Firm*—Christie, Parker and Hale, LLP

(57) ABSTRACT

A plasma display panel (PDP) includes a first substrate and a second substrate opposing one another with a predetermined gap therebetween. The first substrate and the second substrate are substantially rectangular in shape with long side edges and short side edges, and are interconnected by frit deposited between the first substrate and the second substrate. The substrates have a predetermined discharge region and predetermined non-discharge regions that surround the discharge region. The PDP also includes barrier ribs mounted between the first substrate and the second substrate. The barrier ribs are mounted at least partly on the discharge region, and at least partly on the non-discharge regions that are adjacent to the long side edges of the substrates.

20 Claims, 9 Drawing Sheets

PLASMA DISPLAY PANEL HAVING DUMMY BARRIER RIBS

CROSS-REFERENCE TO RELATED APPLICATIONS

This application claims priority to and the benefit of Korean Patent Application No. 2002-0057578 filed on Sep. 23, 2002 in the Korean Intellectual Property Office, the entire content of which is incorporated herein by reference.

BACKGROUND OF THE INVENTION (a) Field of the Invention

The present invention relates to a plasma display panel (PDP), and more particularly, to a PDP that forms dummy barrier ribs in non-display regions.

(b) Description of the Related Art

Plasma display panels (PDPs) are emerging as one of the most popular flat panel display configurations used for wall-mounted televisions and other similar large-screen display applications. Predetermined images are displayed on the PDP using a discharge mechanism of discharge cells. The PDPs typically include a centrally located display region (i.e., discharge region) surrounded by non-display regions (i.e., non-discharge regions). For example, for a rectangular PDP, a centrally located rectangular display region is surrounded by four non-display regions that are adjacent, respectively, to top, bottom, left and right edges of the PDP. In a typical PDP, the top and bottom edges may be referred to as long side edges while the left and right edges may be referred to as short side edges.

The discharge cells are formed using barrier ribs that are provided on a substrate in a predetermined pattern (e.g., a striped or lattice pattern). The barrier ribs include real barrier ribs (hereinafter referred to simply as 'barrier ribs'), which are provided in a display region, and dummy barrier ribs, which are provided in areas other than the display region, that is, in a non-display region. The term 'barrier ribs' may also be used when referring to both the real and dummy barrier ribs together. For instance, the dummy barrier ribs refer to the barrier ribs or a portion thereof that are in the non-display regions such that structural elements of the PDP, that is, a dielectric layer, a protection layer, address electrodes, barrier ribs, and phosphors may be formed in the display region to a stable thickness.

However, in conventional PDPs, the dummy barrier ribs, when used, are formed only in a direction, with respect to the discharge region, towards the short side edges of substrates (assuming the substrates are rectangular in shape) forming the PDP, and not in a direction, with respect to the discharge region, towards the long side edges of the substrates. In other words, the dummy barrier ribs are formed in the non-discharge regions that are adjacent to the short side edges of the substrates and not in the non-discharge regions that are adjacent to the long side edges of the substrates. As a result, when manufacturing the PDP structured in this manner, gaps are formed between one of the two substrates and the barrier ribs during the sealing and exhausting (i.e., vacuuming) processes. These gaps result in the generation of noise during operation of the PDP. This will be described in more detail below with reference to the drawings.

FIG. 10 is a schematic plan view of a conventional PDP. As shown in FIG. 10, barrier ribs 5 define discharge cells that are formed between two substrates 1 and 3. The substrates 1 and 3 are sealed using an adhesive material such as frit 7. The barrier ribs 5 are formed in an established discharge region (or display region) 9. The substrates 1 and 3 are substantially rectangular having short sides and long sides. Dummy barrier ribs (not shown) may be formed in areas outside the discharge region 9, only in non-discharge regions (or non-display regions) 11 that are adjacent to short side edges (and not in non-discharge regions that are adjacent to long side edges) of the substrates.

When performing sealing and exhaust during manufacture of the PDP structured as in the above, a plurality of sealant clips 13 are attached along the long sides of the substrates 1 and 3. The sealant clips 13 apply pressure to the substrates 1 and 3 in a direction toward each other.

However, in this process, the sealant clips 13 make contact with areas of the substrates 1 and 3 between where the frit 7 and the barrier ribs 5 are positioned as shown in FIG. 11, that is, in an empty area between the frit 7 and the barrier ribs 5. As a result, when the sealant clips 13 apply the force needed to ensure an airtight seal between the substrates 1 and 3, at least one of the two substrates 1 and 3 (e.g., the substrate 3 in FIG. 11) is deformed such that minute gaps form between the at least one of the two substrates 1 and 3, and the barrier ribs 5.

If these gaps remain in the final PDP product after sealing the substrates and performing other final processes, noise is generated during operation of the PDP as described above. This significantly reduces the overall quality of the PDP.

SUMMARY OF THE INVENTION

In one exemplary embodiment of the present invention, there is provided a plasma display panel that includes dummy barrier ribs in non-display regions that are adjacent to long side edges of the substrates, such that gaps acting to generate noise during operaton are not formed between the substrates and the barrier ribs. The dummy barrier ribs are formed as an extension of the real barrier ribs into the non-display regions. In an alternate embodiment, the dummy barrier ribs are formed as separate barrier ribs in the non-display regions.

In an exemplary embodiment of the present invention, a plasma display panel includes a first substrate and a second substrate opposing one another with a predetermined gap therebetween. The first substrate and the second substrate are substantially rectangular in shape with long side edges and short side edges, and are interconnected by frit deposited between the first substrate and the second substrate. The substrates have a predetermined discharge region and predetermined non-discharge regions that surround the discharge region. The plasma display panel also includes barrier ribs mounted between the first substrate and the second substrate.

The barrier ribs are mounted at least partly on the discharge region, and at least partly on the non-discharge regions that are adjacent to the long side edges of the substrates.

In another exemplary embodiment according to the present invention, barrier ribs define discharge cells, and may be formed in a striped pattern. The barrier ribs may be formed to extend in a direction that is substantially parallel to the short side edges of the first substrate and the second substrate.

In yet another exemplary embodiment according to the present invention, the barrier ribs mounted on at least one of the non-discharge regions adjacent to the long side edges of the substrates are integrally formed with the barrier ribs mounted on the discharge region. Further, the barrier ribs mounted on said at least one of the non-discharge regions adjacent to the long side edges of the substrates may be extended until contacting the frit.

In still another exemplary embodiment according to the present invention, the barrier ribs mounted on at least one of the non-discharge regions adjacent to the long side edges of the substrates are separated from the barrier ribs mounted on the discharge region. In addition, the barrier ribs mounted on said at least one of the non-discharge regions adjacent to the long side edges of the substrates may be extended until contacting the frit.

Further, the barrier ribs mounted on said at least one of the non-discharge regions adjacent to the long side edges of the substrates may be arranged such that each of the barrier ribs mounted on said at least one of the non-discharge regions adjacent to the long side edges of the substrates corresponds to one of the barrier ribs mounted on the discharge region.

Alternatively, the barrier ribs mounted on said at least one of the non-discharge regions adjacent to the long side edges of the substrates may be arranged such that one of the barrier ribs mounted on said at least one of the non-discharge regions adjacent to the long side edges of the substrates corresponds to a plurality of the barrier ribs mounted on the discharge region. Further, the barrier ribs mounted on said at least one of the non-discharge regions adjacent to the long side edges may extend in a direction that is substantially parallel to the short side edges until contacting the frit.

In a further exemplary embodiment according to the present invention is provided a plasma display panel, which includes first and second substrates facing one another and having a gap therebetween. Each substrate is substantially rectangular in shape with long side edges and short side edges and has a discharge region and non-discharge regions that surround the discharge region. The plasma display panel has a plurality of barrier ribs mounted between the substrates on the discharge region and at least one barrier rib mounted between the substrates on at least one of the non-discharge regions that are adjacent to the long side edges of the substrates, so as to provide support to the substrates when a sealing pressure is applied to the substrates.

BRIEF DESCRIPTION OF THE DRAWINGS

The accompanying drawings, which together with the specification, illustrate exemplary embodiments of the present invention, and, together with the description, serve to explain the principles of the present invention.

DETAILED DESCRIPTION

Exemplary embodiments of the present invention will now be described in detail with reference to the accompanying drawings.

Figure 1:
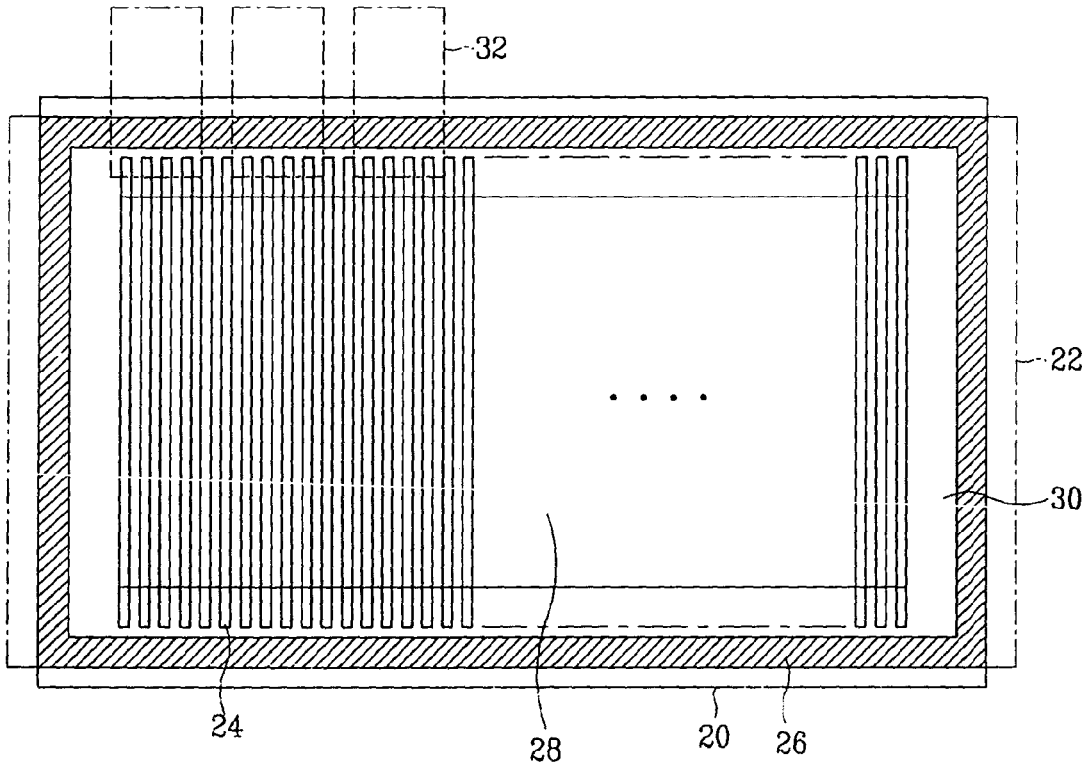
FIG. 1 is a schematic plan view of a plasma display panel according to an exemplary embodiment of the present invention.

FIG. 1 is a schematic plan view of a plasma display panel according to an exemplary embodiment of the present invention. As shown in FIG. 1, the plasma display panel (PDP) includes a transparent first substrate (or lower substrate) 20 and a transparent second substrate (or upper substrate) 22. The substrates 20 and 22 are formed in a substantially rectangular shape having long side edges (in a horizontal direction) and short side edges (in a vertical direction). The first substrate 20 and the second substrate 22 oppose (i.e., face) one another and are substantially parallel to one another. The substrates 20 and 22 have a predetermined gap therebetween.

Barrier ribs 24 that define discharge cells are mounted between the substrates 20 and 22. Also formed between the substrates 20 and 22 is a discharge mechanism (not shown) realized through discharge sustain electrodes, address electrodes, a phosphor layer, and a dielectric layer. The discharge mechanism operates to display images on the PDP.

A discharge region 28 is established in an area that is a predetermined distance from outside edges of the substrate 20 and 22 and that extends to a center thereof, and a non-discharge region 30 is established from where the discharge region 28 ends to the outside edges of the substrates 20 and 22. The discharge region 28 is substantially rectangular in shape, similar to the shape of the substrates 20 and 22. The non-discharge region 30, therefore, is formed as a rectangular band (or periphery) around the discharge region 28. In other words, four non-display regions (that form the non-discharge region 30) are adjacent, respectively, to top, bottom, left and right edges of the PDP, where the top and bottom edges may be referred to as long side edges while the left and right edges may be referred to as short side edges.

Frit 26 is deposited around outside edges of the substrates 20 and 22. That is, the frit 26 is deposited between the substrates 20 and 22 on outer edge surfaces thereof facing one another. The substrates 20 and 22 are sealed together by the frit to thereby define an exterior of the PDP outside the sealed interior. Sealant clips 32 are used during the sealing of the substrates 20 and 22. A suitable number of the sealant clips 32 are used depending on PDP type and the sealing conditions.

The barrier ribs 24 are formed in a direction parallel to the short side edges of the substrates 20 and 22, and extend fully across the discharge region 28 and a predetermined distance into the non-discharge region 30. For example, in the described exemplary embodiment, the barrier ribs 24 are formed in a striped pattern with their lengths arranged uniformly in the direction parallel to the short side edges of the substrates 20 and 22. As shown in FIG. 1, both ends of each of the barrier ribs 24 extend a predetermined distance into the non-discharge region 30 at non-discharge regions that are adjacent to the long side edges. In other embodiments, the barrier ribs 24 may also be formed in other configurations such as a lattice pattern. Further, in this and other exemplary embodiments, the PDP may also include dummy barrier ribs in non-discharge regions that are adjacent to the short side edges.

Figure 2:
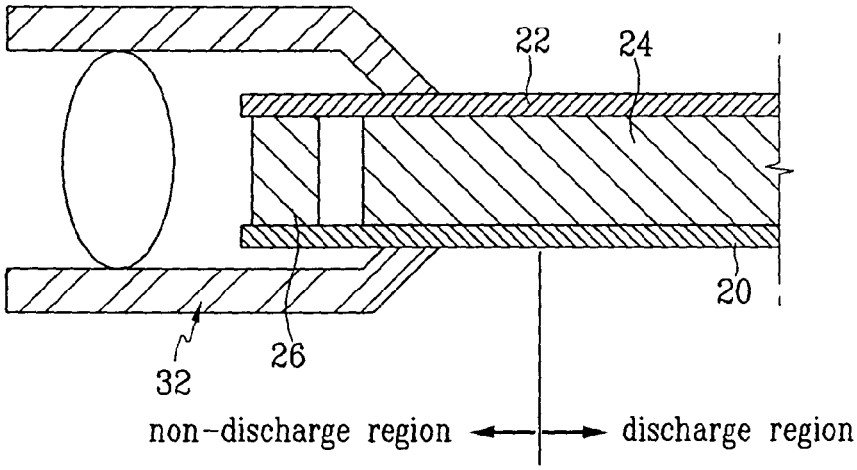
FIG. 2 is a partial side sectional view of the plasma display panel of FIG. 1 with a sealant clip attached thereto.

When performing the sealing process on the PDP having the barrier ribs 24 structured as described above, the sealant clips 32, as shown in FIG. 2, are placed onto the exterior of both of the substrates 20 and 22 at areas corresponding to the non-discharge region 30. The sealant clips 32 apply pressure onto the substrates 20 and 22 in a direction toward each other. Since the barrier ribs 24 are formed extending into the non-discharge region 30, no warping or other such deformation of the substrates 20 and 22 occurs.

That is, the barrier ribs 24 are extended corresponding to at least the area where the sealant clips 32 are positioned on the substrates 20 and 22 such that the substrates 20 and 22 are fully supported in this area, thereby preventing the substrates 20 and 22 from being displaced inwardly in a direction toward each other. Such inward displacement of the substrates 20 and 22 would cause deformation of these elements, and ultimately, the formation of gaps between one or both of the substrates 20 and 22 and the barrier ribs 24. Therefore, ends of the barrier ribs 24 act as dummy barrier ribs that prevent gaps from being formed between the substrates 20 and 22 and the barrier ribs 24.

Table 1 below shows results of a test performed by the inventors, in which the different noise levels generated by PDPs of the described exemplary embodiment of the present invention and of the prior art are compared. For the test, only the barrier ribs were varied in configuration and the remaining structures of the PDPs were identical. It is clear from the data presented in Table 1 that the PDP of FIG. 1 generates less noise than the conventional PDP.

TABLE 1

Noise Comparison between PDP of FIG. 1 and Conventional PDP

| PDP of FIG. 1 | | | Conventional PDP | | |
|---|---|---|---|---|---|
| Area of measurement | Noise(dB) | Noise level rating | Area of measurement | Noise(dB) | Noise level rating |
| Front of PDP | 27.0 | Average | Front of PDP | 33.4 | Average |
| | 29.9 | Maximum | | 37.2 | High |
| | 25.4 | Minimum | | 30.7 | Low |
| Rear of PDP | 31.7 | Average | Rear of PDP | 35.6 | Average |
| | 33.3 | Maximum | | 37.9 | Maximum |
| | 30.0 | Minimum | | 33.6 | Minimum |

Figure 3:
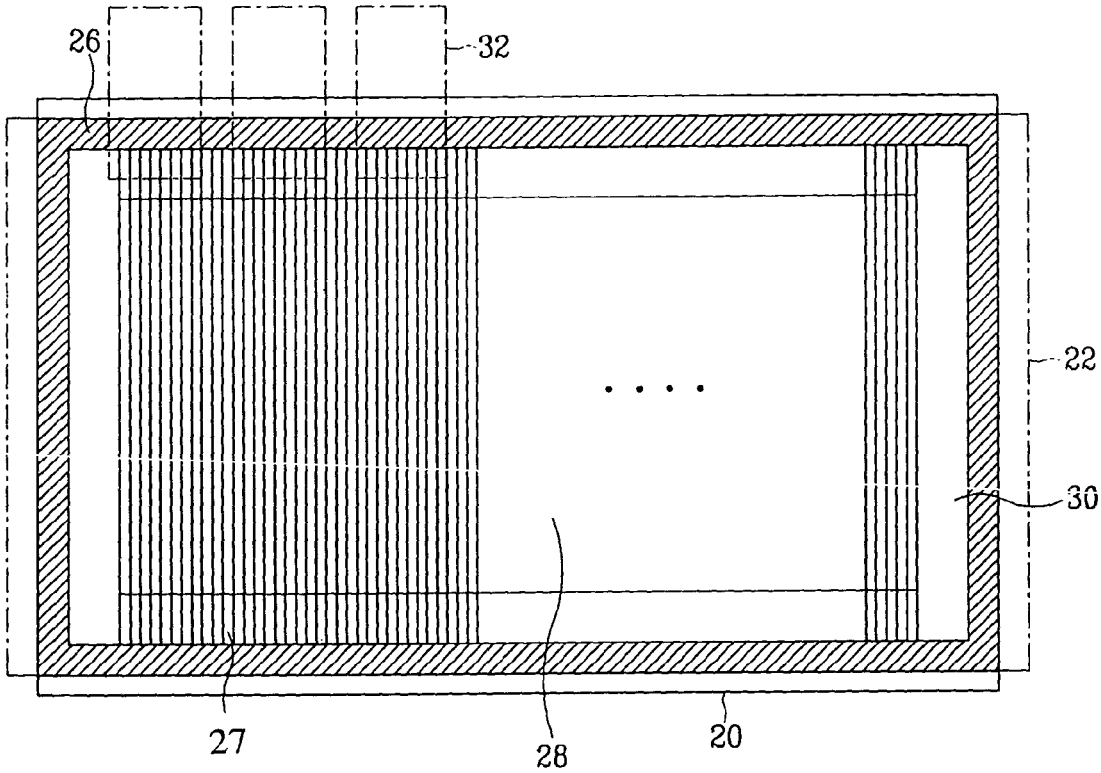
FIG. 3 is a schematic plan view of a plasma display panel according to another exemplary embodiment of the present invention.

FIG. 3 is a schematic plan view showing another exemplary embodiment of a PDP of the present invention. The PDP of FIG. 3 is identical to the PDP of FIG. 1 except for the extent to which the barrier ribs extend into the non-discharge regions that are adjacent to the long side edges. In this exemplary embodiment, barrier ribs 27 are extended in a direction parallel to the short side edges on both ends thereof until making contact with the frit 26. With this configuration, even greater support is provided to the substrates 20 and 22 when the sealant clips 32 are attached thereto during the sealing process. This further ensures that deformation of the substrates 20 and 22 by the sealant clips 32 does not take place.

Figure 4:
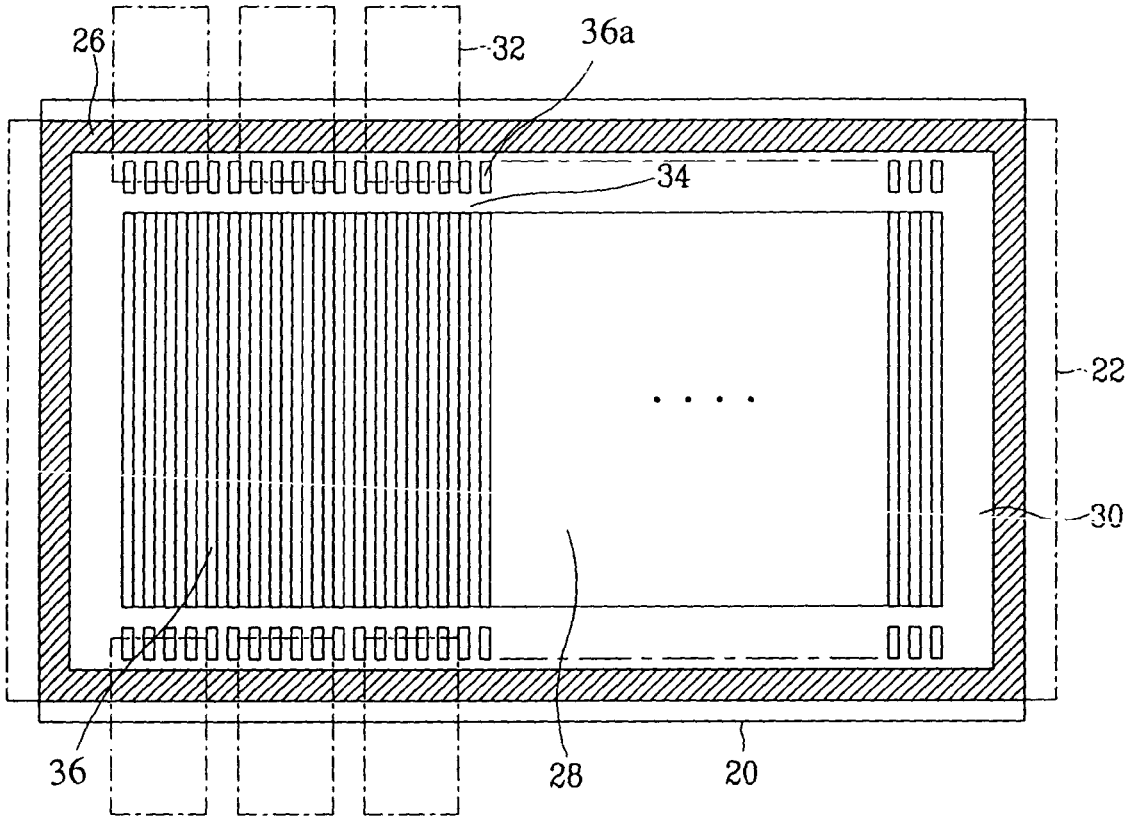
FIG. 4 is a schematic plan view of a plasma display panel according to yet another embodiment of the present invention.

FIG. 4 is a schematic plan view of a PDP according to another exemplary embodiment of the present invention. Except for primary barrier ribs 36 and secondary barrier ribs 36*a*, the PDP of this embodiment is identical to the PDP of FIG. 1. In other words, first (lower) and second (upper) substrates 20 and 22, a discharge mechanism, discharge and non-discharge regions 28 and 30, and frit 26 are formed identically as the corresponding components of FIG. 1. Identical sealant clips 32 are also used for this embodiment.

In this embodiment, the barrier ribs (i.e., the primary barrier ribs) 36 do not extend into the non-discharge region 30. Instead, the PDP includes the secondary barrier ribs 36*a* that are formed in the non-discharge region 30 as components that are separate from the primary barrier ribs 36. The primary barrier ribs 36 are aligned uniformly only in the discharge region 28, with ends of the primary barrier ribs 36 reaching the edges of long sides of the discharge region 28. The secondary barrier ribs 36*a* are mounted at non-discharge regions (of the non-discharge region 30) that are adjacent to the long side edges at areas corresponding to where the sealant clips 32 are mounted to the substrates 20 and 22, and at a predetermined distance from the primary barrier ribs 36. With the separation of the secondary barrier ribs 36*a* from the primary barrier ribs 36, passageways 34 are formed between the primary barrier ribs 36 and the secondary barrier ribs 36*a* (one on each side in a direction parallel to the long side edges). The passageways 34 allow for easier exhaust of the interior of the PDP, for example, when the gas between the substrates 20 and 22 is removed so as to create vacuum therein.

Hence, the PDP in the exemplary embodiment of FIG. 4 prevents the generation of noise as described in reference to the exemplary embodiment of FIG. 1, and also allows for an efficient exhaust of gas from the interior of the PDP.

FIGS. 5 through 9 are schematic plan views showing other exemplary embodiments of the PDP of the present invention.

Figure 5:
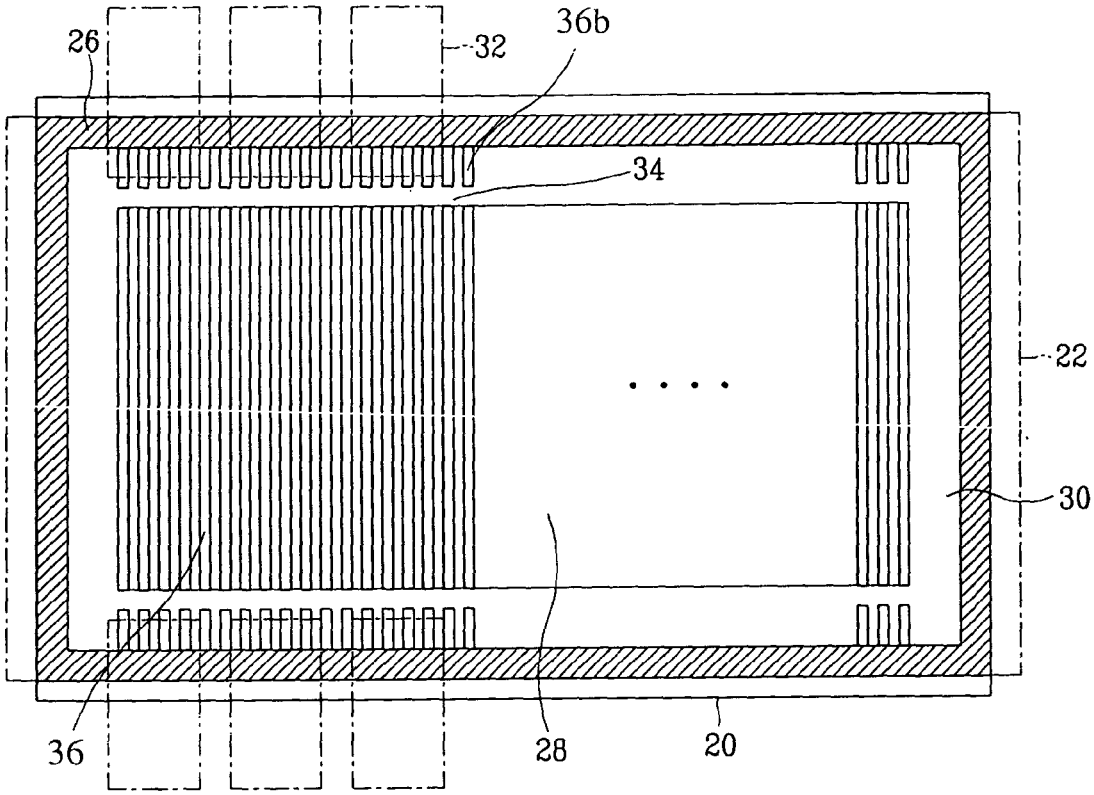
FIGS. 5 through 9 are schematic plan views showing plasma display panels according to other exemplary embodiments of the present invention.

Referring first to FIG. 5, the PDP in another exemplary embodiment according to the present invention is formed identically to that of the PDP of FIG. 4, including the formation of the passageways 34 between the primary barrier ribs 36 and secondary barrier ribs 36*b*. However, the secondary barrier ribs 36*b* mounted in the non-discharge region 30 at regions adjacent to the long side edges are formed extending in a direction away from the primary barrier ribs 36 until contacting the frit 26. In other words, unlike the secondary barrier ribs 36*a* of FIG. 4 which do not touch the frit 26, the secondary barrier ribs 36*b* of FIG. 5 extend all the way to the frit 26. This configuration provides for even greater support of the substrates 20 and 22 when the sealant clips 32 are mounted thereon.

In FIGS. 4 and 5, each of the primary barrier ribs 36 has a corresponding secondary barrier rib 36*a* or 36*b*, respectively. In other words, the number of secondary barrier ribs are identical to the number of primary barrier ribs. However, in other embodiments, different numbers of primary and secondary barrier ribs may be used.

Figure 6:
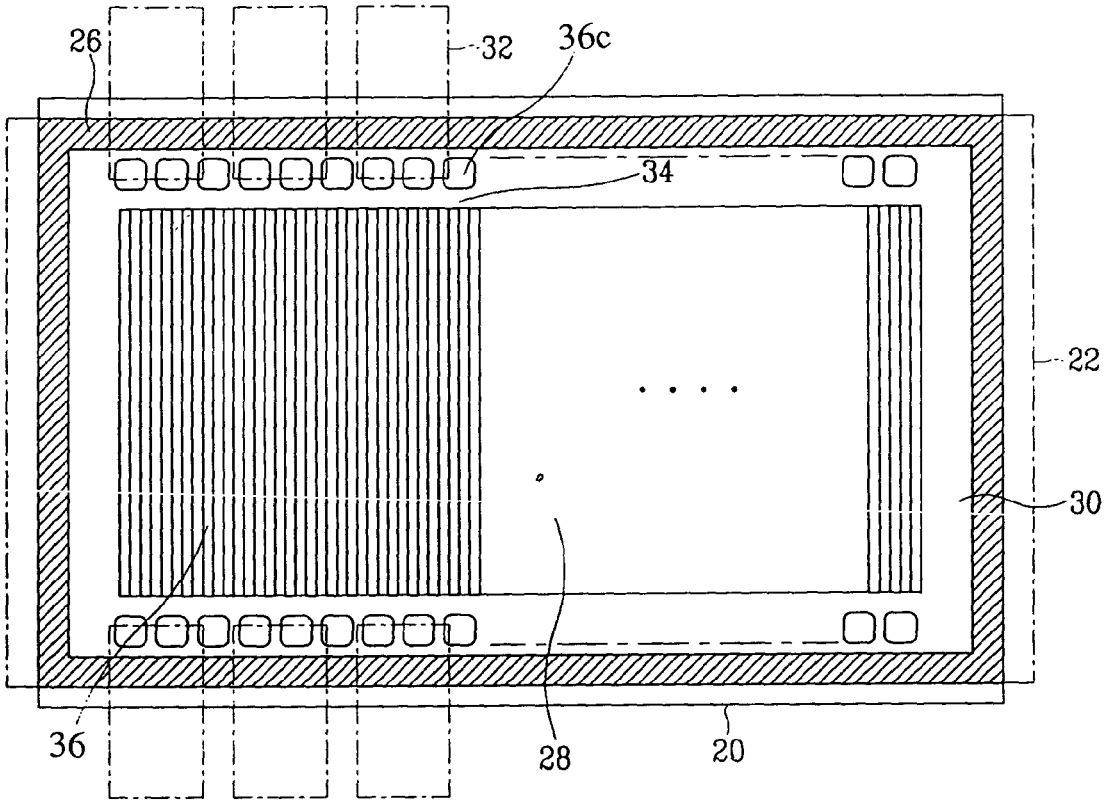
Figure 7:
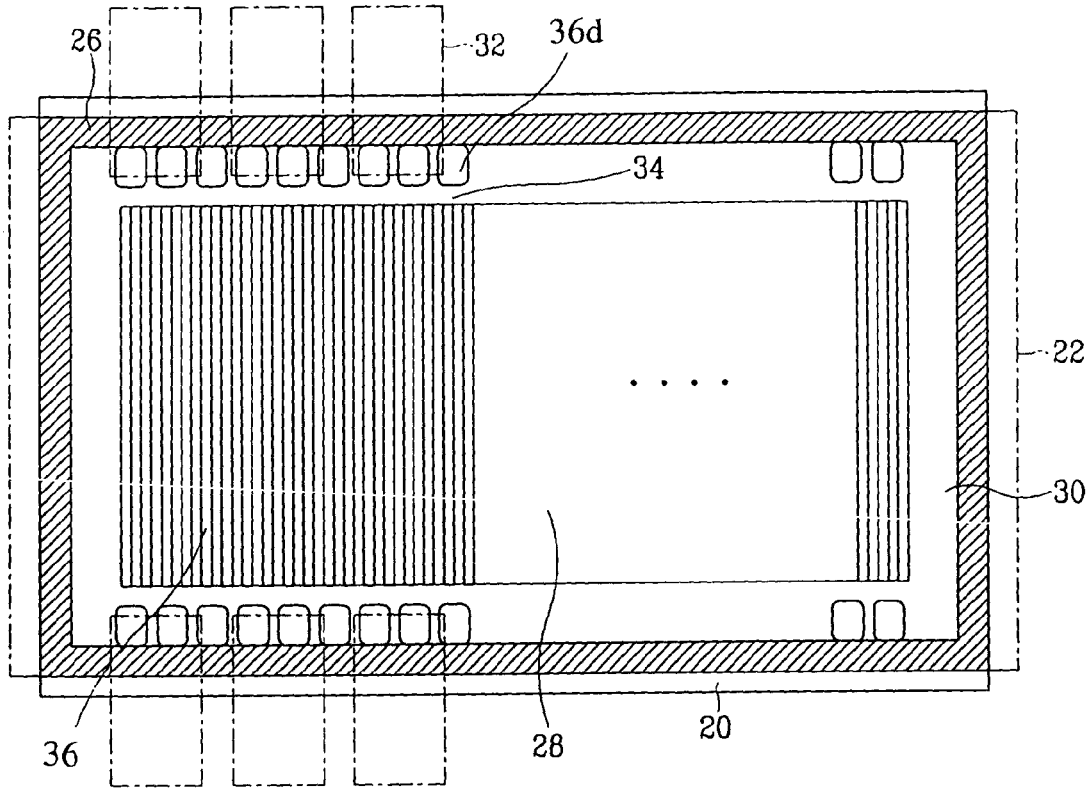

For example, with reference to FIGS. 6 and 7, secondary barrier ribs 36*c* and 36*d*, respectively, mounted in the non-discharge region 30 at regions adjacent to the long side edges are formed in such a manner that one of the secondary barrier ribs 36*c* or 36*d* corresponds to more than one of the primary barrier ribs 36. This structure is present in both the non-discharge regions that are adjacent to the long side edges. Also, the secondary barrier ribs 36*c* and 36*d* are formed separated at a predetermined distance from the primary barrier ribs 36 such that passageways 34 are formed therebetween, thereby allowing better exhaust of the interior of the PDP as described above.

The configuration of the exemplary embodiments of FIGS. 6 and 7 is such that an area occupied by the secondary barrier ribs 36*c* and 36*d*, respectively, is increased over that occupied by the barrier ribs 36*a* and 36*b* of FIGS. 3 and 4, respectively. The secondary barrier ribs 36*c* and 36*d*, therefore, provide more support to the substrates 20 and 22 during the sealing process than the secondary barrier ribs that have the same width as the primary barrier ribs, ultimately resulting in better prevention of noise generation during operation of the PDP.

It should be noted in FIGS. 6 and 7 that the width of the secondary barrier ribs 20 and 22 does not necessarily equal to a total width of multiple primary barrier ribs including spaces between the multiple primary barrier ribs.

Despite many similarities, the secondary barrier ribs 36*d* of FIG. 7 are different from the secondary barrier ribs 36*c* of FIG. 6 in that the secondary barrier ribs 36*d* touch the frit 26. By extending all the way up to the frit 26, the secondary barrier ribs 36*d* provide increased support to the substrates 20 and 22 during the sealing process as compared to the secondary barrier ribs 36*c* that do not extend to the frit 26.

Figure 8:
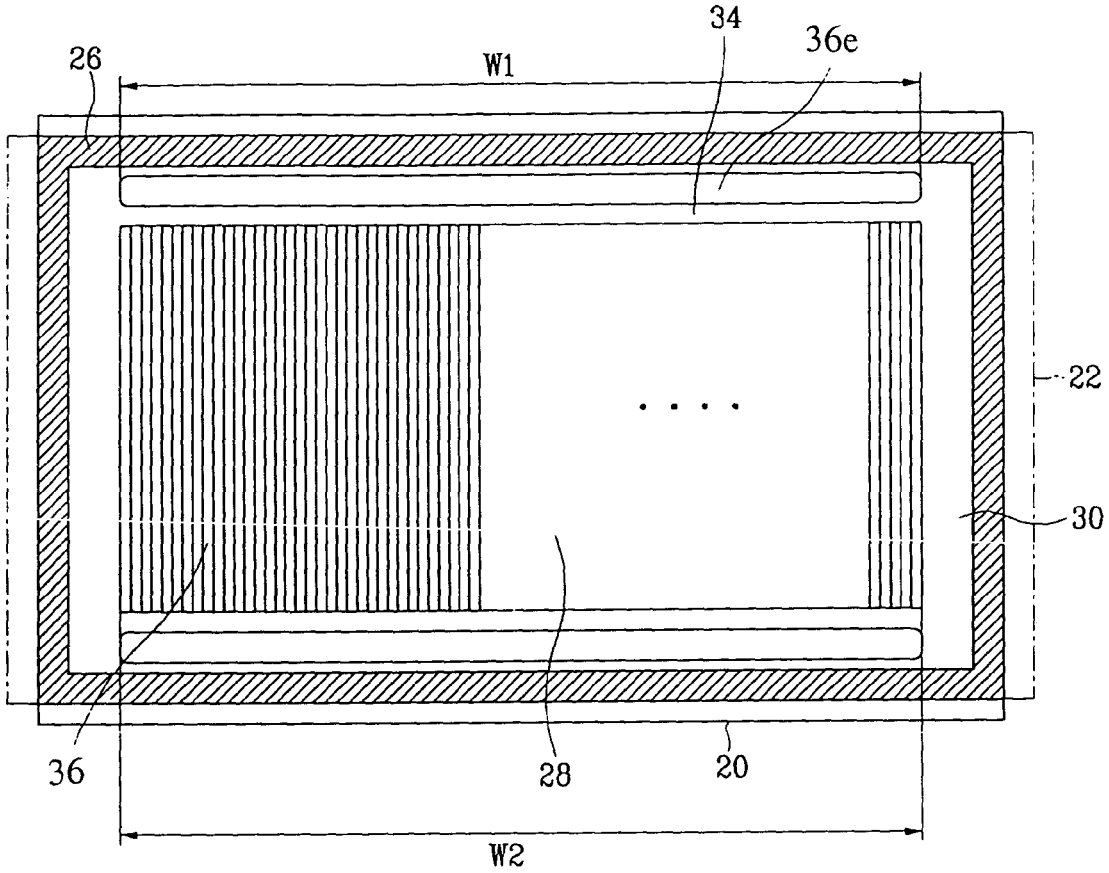

The PDP in an exemplary embodiment illustrated in FIG. 8 includes a single secondary barrier rib 36*e* that extends in a direction parallel to the long side edges across the display region 28 in each of the two non-discharge regions that are adjacent to the long side edges (e.g., top and bottom edges) of the PDP. For example, the width of the secondary barrier rib 36*e* in FIG. 8 correspond to a total width of the primary barrier ribs 36, including spaces between the primary barrier ribs 36. With this configuration, a width W1 of the secondary barrier ribs 36*e* in the direction parallel to the long side edges of the substrates 20 and 22 is substantially identical to a total width W2 of an area occupied by all the primary barrier ribs 36 in the same direction. Further, in the exemplary embodiment of FIG. 8, the corners of the secondary barrier ribs 36*e* are rounded. In other embodiments, the secondary barrier ribs 36*e* may have a width that is longer than or shorter than the total width of the area occupied by all the primary barrier ribs 36. Further, the corners of the secondary barrier ribs 36*e* may not be rounded.

Figure 9:
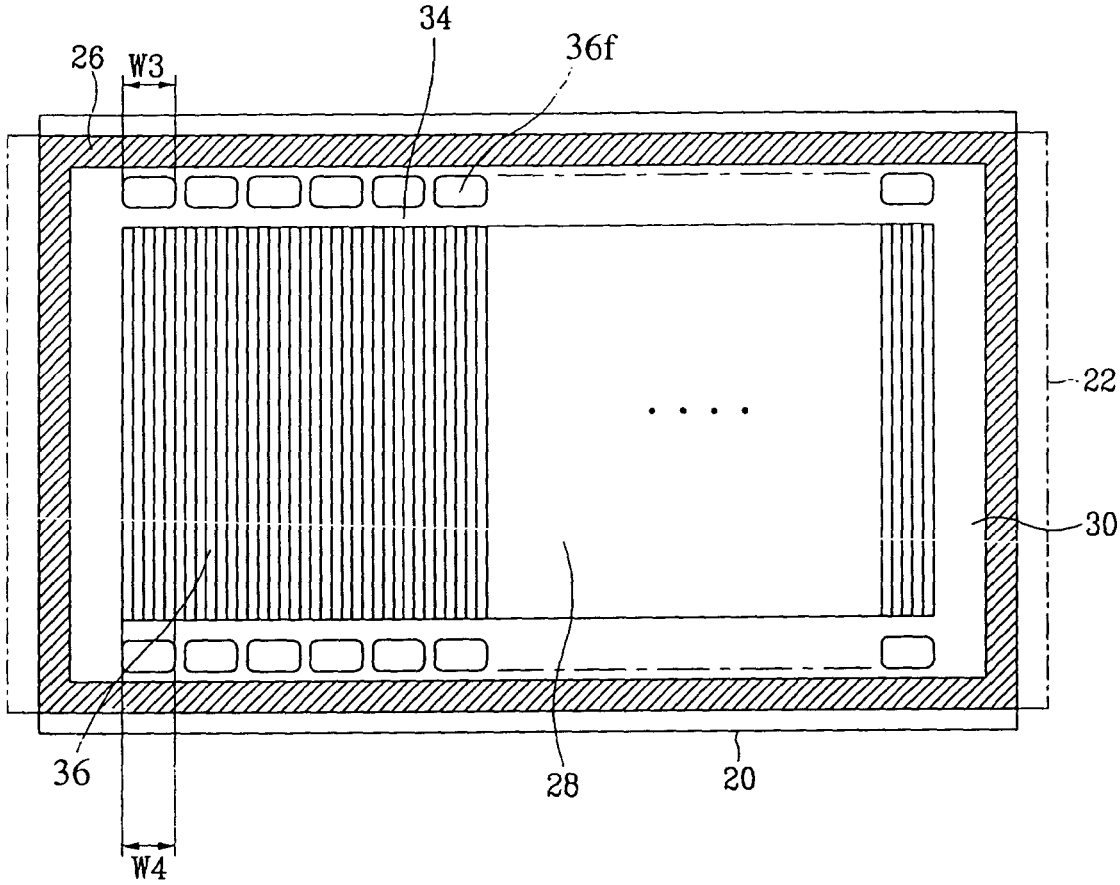
Figure 10:
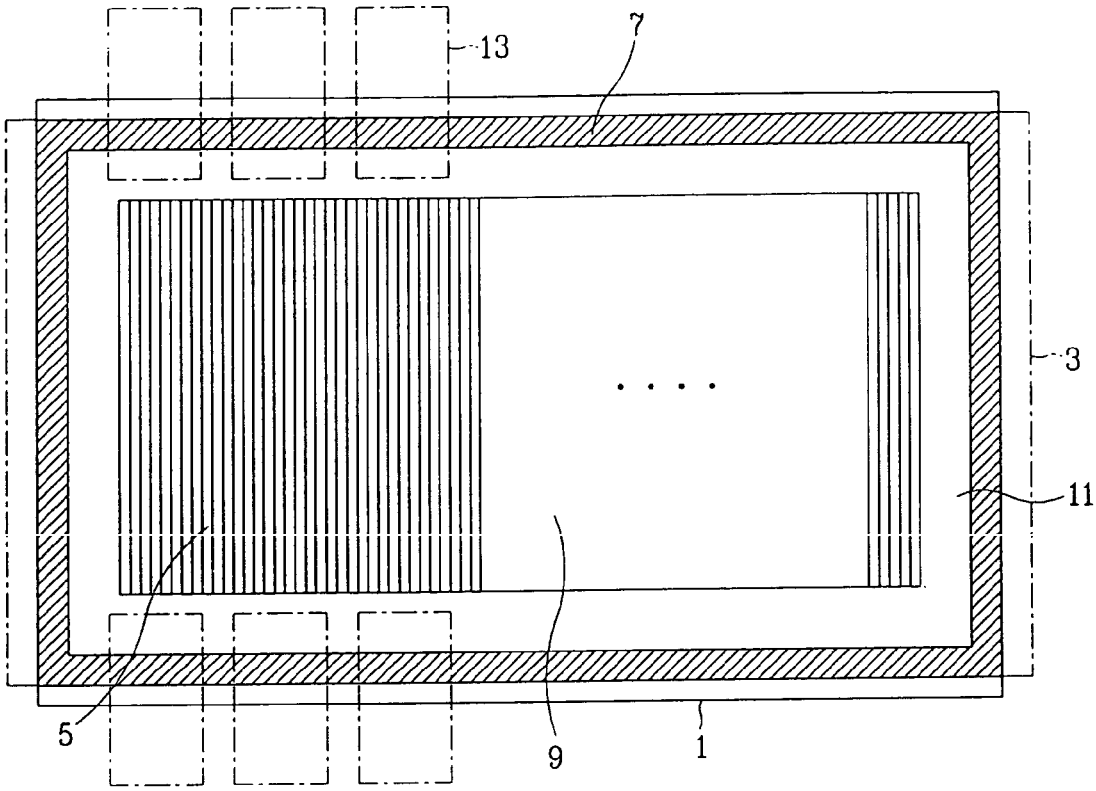
FIG. 10 is a schematic plan view of a conventional plasma display panel.
Figure 11:
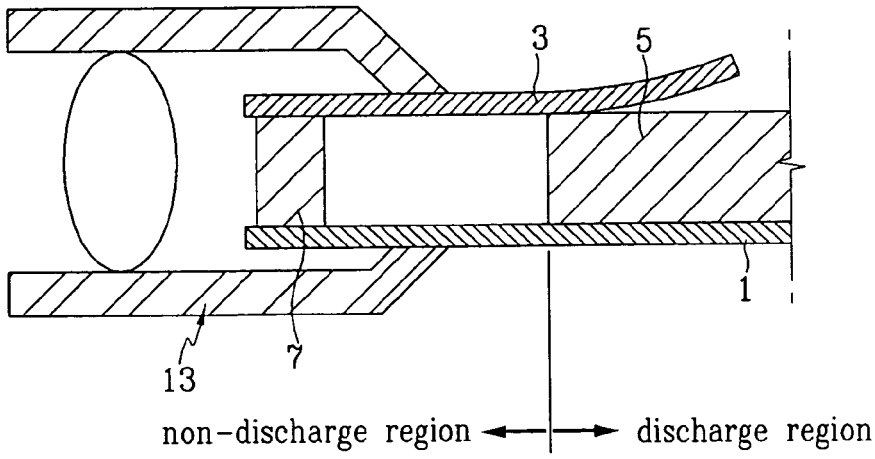
FIG. 11 is a partial side sectional view of the plasma display panel of FIG. 10 with a sealant clip attached thereto.

In a PDP in an exemplary embodiment illustrated in FIG. 9, a plurality of secondary barrier ribs 36*f* are mounted in each of the non-discharge regions that are adjacent to the long side edges of the substrates 20 and 22 in such a manner that a width W3 of each of the secondary barrier ribs 36*f* in the same direction is substantially identical to a width W4 of an area occupied by a predetermined number of the primary barrier ribs 24 in the direction parallel to the long side edges of the substrates 20 and 22. In this exemplary embodiment, the corners of the secondary barrier ribs 36*f* are rounded as described above in reference to FIG. 8. In other exemplary embodiments, the corners of the secondary barrier may not be rounded.

In the PDPs in exemplary embodiments of the present invention described above, gaps are prevented from being formed between the barrier ribs and the substrates during the sealing process by the structure of the barrier ribs in the non-display regions (i.e., the non-discharge regions).

Further, by separating the barrier ribs formed in the non-discharge regions from the barrier ribs formed in the discharge regions, easy exhaust of the interior of the PDP may be performed. It should be noted here that with a minimal gap between the barrier ribs in the non-discharge regions and the barrier ribs in the discharge region, the sealant clips may be attached at areas of the substrates corresponding to where the barrier ribs in the non-discharge regions are positioned, and also at areas of the substrates corresponding to between the barrier ribs in the non-discharge regions and the barrier ribs in the discharge region are mounted.

Therefore, the PDPs in exemplary embodiments of the present invention prevent the generation of noise caused by gaps formed between the barrier ribs and the substrates, and may also allow for the efficient exhaust of the interior of the PDP.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing one another with a predetermined gap therebetween, the first substrate and the second substrate being substantially rectangular in shape with long side edges and short side edges, and being interconnected by frit deposited between the first substrate and the second substrate, said substrates having a predetermined discharge region and predetermined non-discharge regions that surround the discharge region, the predetermined discharge region and the predetermined non-discharge regions being within an area sealed by the frit; and barrier ribs mounted between the first substrate and the second substrate, wherein the barrier ribs are mounted at least partly on the discharge region, and at least partly on the non-discharge regions that are adjacent to the long side edges of the substrates, and wherein at least two of the barrier ribs are mounted at least partly on the non-discharge regions.

2. The plasma display panel of claim 1, wherein the barrier ribs define discharge cells.

3. The plasma display panel of claim 1, wherein the long side edges are top and bottom edges of the substrates, and the short side edges are left and right edges of the substrates.

4. The plasma display panel of claim 1, wherein the barrier ribs are formed in a striped pattern.

5. The plasma display panel of claim 1, wherein the barrier ribs are formed to extend in a direction that is substantially parallel to the short side edges of the first substrate and the second substrate.

6. The plasma display panel of claim 1, wherein the barrier ribs mounted on at least one of the non-discharge regions adjacent to the long side edges of the substrates are integrally formed with the barrier ribs mounted on the discharge region.

7. The plasma display panel of claim 6, wherein the barrier ribs mounted on said at least one of the non-discharge regions adjacent to the long side edges of the substrates are extended until contacting the frit.

8. The plasma display panel of claim 1, wherein the barrier ribs mounted on at least one of the non-discharge regions adjacent to the long side edges of the substrates are separated from the barrier ribs mounted on the discharge region.

9. The plasma display panel of claim 8, wherein the barrier ribs mounted on said at least one of the non-discharge regions adjacent to the long side edges of the substrates are extended until contacting the frit.

10. The plasma display panel of claim 9, wherein the barrier ribs mounted on said at least one of the non-discharge regions adjacent to the long side edges of the substrates are arranged such that each of the barrier ribs mounted on said at least one of the non-discharge regions adjacent to the long side edges of the substrates corresponds to one of the barrier ribs mounted on the discharge region.

11. The plasma display panel of claim 8, wherein the barrier ribs mounted on said at least one of the non-discharge regions adjacent to the long side edges are arranged such that one of the barrier ribs mounted on the non-discharge regions corresponds to a plurality of the barrier ribs mounted on the discharge region.

12. The plasma display panel of claim 11, wherein the barrier ribs mounted on said at least one of the non-discharge regions adjacent to the long side edges extend in a direction that is substantially parallel to the short side edges until contacting the frit.

13. The plasma display panel of claim 11, wherein a width in a direction that is substantially parallel to the long side edges of the substrates of the barrier ribs mounted on said at least one of the non-discharge regions adjacent to the long side edges of the substrates is substantially identical to a width in the direction that is substantially parallel to the long side edges of the substrates of an area occupied by all the barrier ribs mounted on the discharge region, said area including spaces between the barrier ribs.

14. The plasma display panel of claim 11, wherein a width in a direction that is substantially parallel to the long side edges of the substrates of the barrier ribs mounted on said at least one of the non-discharge regions adjacent to the long side edges of the substrates is substantially identical to a width in the direction that is substantially parallel to the long side edges of the substrates of an area occupied by a predetermined number of the barrier ribs mounted on the discharge region, said area including spaces between the barrier ribs.

15. The plasma display panel of claim 11, wherein corners of the barrier ribs mounted on said at least one of the non-discharge regions adjacent to the long side edges of the substrates are rounded.

16. The plasma display panel of claim 8, wherein during a sealing process of the plasma display panel, a sealing pressure is applied to the substrates at areas corresponding to where the barrier ribs are mounted on said at least one of the non-discharge regions that are adjacent to the long side edges of the substrates.

17. The plasma display panel of claim 8, wherein during a sealing process of the plasma display panel, a sealing pressure is applied to the substrates at areas corresponding to between where the barrier ribs are mounted on said at least one of the non-discharge regions adjacent to the long side edges of the substrates and where the barrier ribs are mounted on the discharge region.

18. The plasma display panel comprising:

first and second substrates facing one another and having a gap therebetween, each substrate being substantially rectangular in shape with long side edges and short side edges and having a discharge region and non-discharge regions that surround the discharge region, the discharge region and the non-discharge regions being within an area sealed by a frit;

a plurality of barrier ribs mounted between the substrates on the discharge region; and a plurality of barrier ribs mounted between the substrates on the non-discharge regions that are adjacent to the long side edges of the substrates, so as to provide support to the substrates when a sealing pressure is applied to the substrates.

19. The plasma display panel of claim 18, wherein said plurality of barrier ribs mounted on the non-discharge regions are formed integrally with one of the plurality of barrier ribs.

20. The plasma display panel of claim 18, wherein said plurality of barrier ribs mounted on the non-discharge regions are formed separately from the plurality of barrier ribs.

* * * * *